US005320039A

United States Patent [19]

Reponty et al.

[11] Patent Number: 5,320,039

[45] Date of Patent: Jun. 14, 1994

[54] WEB ENGAGEMENT SYSTEM FOR AN OFF-REEL PRINTING PRESS

[75] Inventors: Andre Reponty, Gouvieux; Jean-Claude Marmin, Denis, both of France

[73] Assignee: Heidelberger Druckmachinen AG, Heidelberg, Fed. Rep. of Germany

[21] Appl. No.: 981,624

[22] Filed: Nov. 25, 1992

[30] Foreign Application Priority Data

Nov. 26, 1991 [FR] France ..... 9114851

[51] Int. Cl.[5] ..... B41F 13/54

[52] U.S. Cl. ..... 101/228; 226/92; 226/147; 226/150; 226/12; 226/49; 226/50

[58] Field of Search ..... 101/225, 226, 227, 228, 101/232; 226/91, 92, 147, 148, 149, 150, 151, 12, 49, 50; 318/103

[56] References Cited

U.S. PATENT DOCUMENTS

| | | | |
|---|---|---|---|
| 2,862,705 | 12/1958 | Faeber | 271/2.1 |
| 3,045,884 | 7/1962 | Buhrendorf | 318/103 |
| 3,084,881 | 4/1963 | Wulf | 226/50 |
| 4,605,147 | 8/1986 | Kato | 226/147 |
| 4,987,830 | 1/1991 | Fukuda et al. | 101/228 |
| 5,029,742 | 7/1991 | Theilacker et al. | 226/92 |
| 5,052,295 | 10/1991 | Suzuki et al. | 101/227 |
| 5,102,026 | 4/1992 | Messner | 226/147 |
| 5,201,269 | 4/1993 | Eckert | 101/228 |

FOREIGN PATENT DOCUMENTS

| | | |
|---|---|---|
| 0425741 | 5/1991 | European Pat. Off. . |
| 1394809 | 3/1965 | France . |

*Primary Examiner*—Eugene H. Eickholt
*Attorney, Agent, or Firm*—Kenyon & Kenyon

[57] ABSTRACT

A web engagement system for an off-reel printing press comprising a guide piece, a guide channel and drive stations for the displacement of the guide piece. The guide channel accommodates and guides the guide piece and is located on the frame of the press between the drive stations. The guide piece is slightly longer than the distance separating the various drive stations. The advance of the guide piece is caused as a result of the displacement of a slide equipped with wedging rollers which alternately grip and release the guide piece. A pair of wedging rollers prevents the return movement of the guide piece. The invention is used for introducing paper webs unwinding continuously in an off-reel printing press.

19 Claims, 7 Drawing Sheets

Fig.1
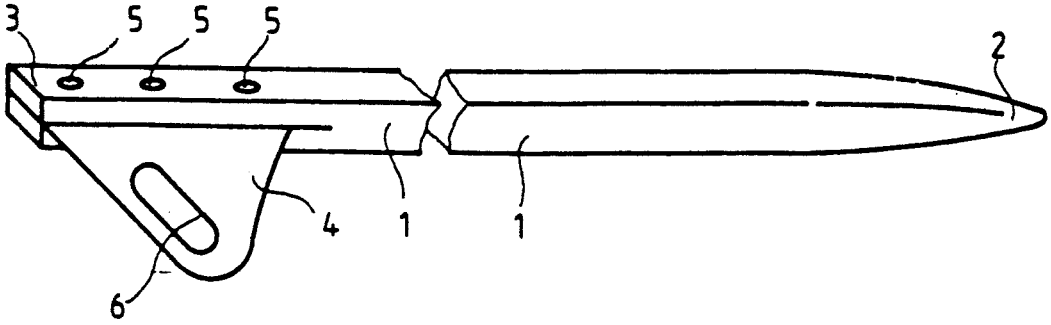
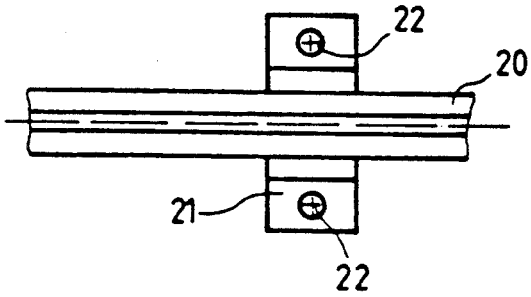
Fig. 2a
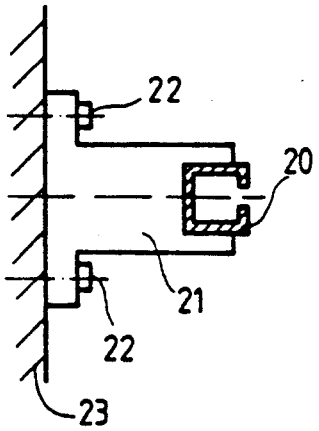
Fig. 2b

WEB ENGAGEMENT SYSTEM FOR AN OFF-REEL PRINTING PRESS

FIELD OF THE INVENTION

The present invention relates to off-reel printing presses, and more particularly, to a web engagement system for an off-reel printing press.

BACKGROUND INFORMATION

Off-reel printing presses, whatever the printing process used, print onto a continuous paper web unwinding from a reel. These presses are generally composed of the following components: a reelstand which supplies a paper web at a regulated tension; an infeeder which increases the paper tension provided by the reelstand and which improves the tension regulation; printing units which deposit ink films of various colors onto the paper in so-called "printing" zones; a hot-air drier which dries the ink film by blowing hot air; chill rolls which return the paper to ambient temperature at its exit from the drier; a paper passage which cuts the various webs into strips, superposes them by means of turning bars and puts them in phase so as to bring the pages of the various strips into coincidence by means of cutting registers; and a folder or open-sheet delivery which cuts the continuous web arriving there and, if appropriate, folds it to form a folded booklet.

These various components include a large number of free or driven rollers, on which the running web passes and changes direction. Before the printing press is put into operation, the web has to be "engaged" between or around the various rollers.

The engagement operation has in the past traditionally been carried out by hand. Several operators moving around the machine would pass the leading edge of the paper web to one another. The leading edge of the web may be cut to a point to make it easier to pass it between the many pairs of rollers involved in the printing process.

Manual engagement of the web is lengthy and laborious, because it is necessary to climb into the structure of the machine in order to engage the web on the paper-passage rollers, and could be dangerous if the various pairs of engaging rollers were not protected by "finger guards".

It should also be noted that, on most printing presses, the paper does not follow a single path. Depending on the final product desired, it can follow different paper paths and therefore pass over the various rollers in a different order.

An improved engagement system known as "engagement belts" is well known. This system involves providing idle pulleys at the end of the various rollers on which an endless belts travels following the path most often travelled by the paper. When it has reached the end of its travel, this belt has to return to its starting point on a series of so-called return pulleys. It is necessary to provide tensioning devices for keeping this belt at a suitable tension and a drive device for driving the system as a whole. To engage the paper, it is cut obliquely to make a point, on the side where the engagement belts is located, this point is attached to the engagement belts and the press and the drive system of the cords are put into operation so that the paper is carried by these from roller to roller. It should be noted, however, that such belts have single and invariable paths and therefore do not allow a plurality of paper passes to be executed according to choice. This system is generally satisfactory, especially on presses for printing the daily newspapers.

This system can be modified to provide a plurality of belts, for example one on each side of the breadth of the paper to be engaged, these belts carrying out the engagement along different paths. In this arrangement, moreover, the paper can be secured to one of the belts over a particular length of the path and to the other belts over another part. It should be noted, however, that this solution is not fully automatic and requires a considerable involvement of personnel.

There are other known engagement systems, in which a bar passes across the width of the paper breadth, being connected on the two sides of the latter to chains or to cables driven in synchronism by a winch located at the end of the machine. In this arrangement, the chains or cables pass over pulleys, the axles of which are fastened on either side of the frames of the machine. To engage the web, its end is fastened to the engagement bar by means of adhesive tape and the printing press and winch are set in slow motion. The engagement bar is displaced according to the path of the chains or cables and introduces the web along this path. This system can be "endless" with the chains or cables arranged on a continuous looped path.

Other systems employ an unwinder having an "unwinding" chain or cable winch and a "winding" winch near the folder end of the machine. When the web has been engaged, the bar of the chain or cable drive system is disconnected and the chain or cable is rewound onto the "unwinding" winch. Here again, the main disadvantage of this system is that it enables the paper to be engaged only along a single path.

Systems have been proposed, in which a roller chain section of a length of only a few meters is displaced in a channel fastened against the frame of the machine. This channel has a C-shaped cross-section, thus ensuring that the chain is retained in the channel. At the rear of the chain section, a hook emerges through the orifice of the channel and serves for attaching the point formed in the paper web to be engaged. Of course, the chain is arranged in the channel in such a way that its rollers and therefore its axes of articulation are parallel to the axes of the rollers and cylinders of the press. To drive this chain, along the channel, there are at a fixed station electric or pneumatic motors driving chain pinions, the axes of which are themselves parallel to the axes of the rollers of the press. These chain pinions mesh with the chain through slots made at fixed intervals in the wall of the chain guide channel.

The roller chain arrangement is such that the distance, along the channel, between two chain pinions is smaller than the length of the chain section, so that this section is pushed along in the channel as far as the following pinion which then meshes with it and pulls it. Electric or pneumatic chain presence detectors are used for starting and stopping the motors, these operating only when a chain passes through them.

The advantage of this system over the preceding ones is that it makes it possible to engage the web along varied paths. It is possible, in fact, to arrange switches on the channels between the various sections and to direct the chain different ways.

OBJECTS AND SUMMARY OF THE INVENTION

An object of the present invention is to provide a web engagement system which is capable of engaging the web on various paths by means of switches.

Another object of the present invention is to provide a web engagement system which is capable of regulating the amount of pull on the web, while at the same time having a very low inertia, thus avoiding paper breaks in the event of a momentary slowing of the web.

Another object of the present invention is to provide a web engagement system which is capable of making the advance of the web proportional to the machine speed and of having the capacity to adjust the proportionality factor independently on each drive sector.

A further object of the present invention is to provide a web engagement system which is capable of being driven both forwards and backwards automatically.

A further object of the present invention is to provide a web engagement system which is capable of varying the distance between the axis of the web and the engagement device.

Another object of the present invention is to provide a web engagement system which is simple and economical to construct, which is controlled by means of a compressedair supply and two electrical wires connecting a plurality of drive stations to one another.

The present invention provides a web engagement system for an off-reel printing press having a frame, comprising: at least one guide piece; at least one guide channel mounted to the frame of the printing press for accommodating and guiding the guide piece; and a plurality of drive stations located along the guide channel for displacing the guide piece.

The present invention also provides a web engagement system for an off-reel printing press having a frame, comprising: a guide piece; a guide channel; a plurality of drive stations for displacing the guide piece, the guide channel serving for accommodating and guiding the guide piece and being located on the frame of the press between the drive stations, the guide piece being slightly longer than the distance separating the various drive stations; and wherein each drive station has a slide equipped with wedging rollers which advances the guide piece by alternately gripping and releasing it.

Other characteristics and advantages of the present invention will become apparent from the following description and accompanying drawings.

BRIEF DESCRIPTION OF THE DRAWINGS

FIG. 1 is an elevational view of a guide piece of the present invention.

FIGS. *2a* and *2b* are a side plan view and a cross-sectional view, respectively, of a guide channel of the present invention.

Figure 3:
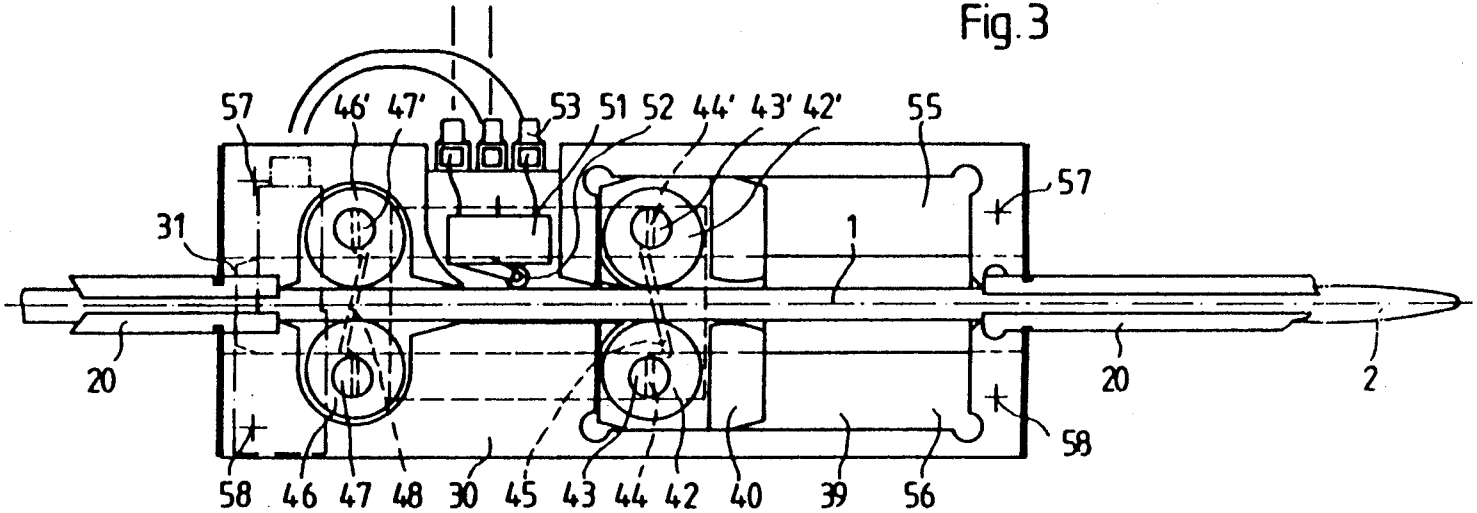

FIG. 3 is side plan view of a drive station of the present invention.

Figure 4:
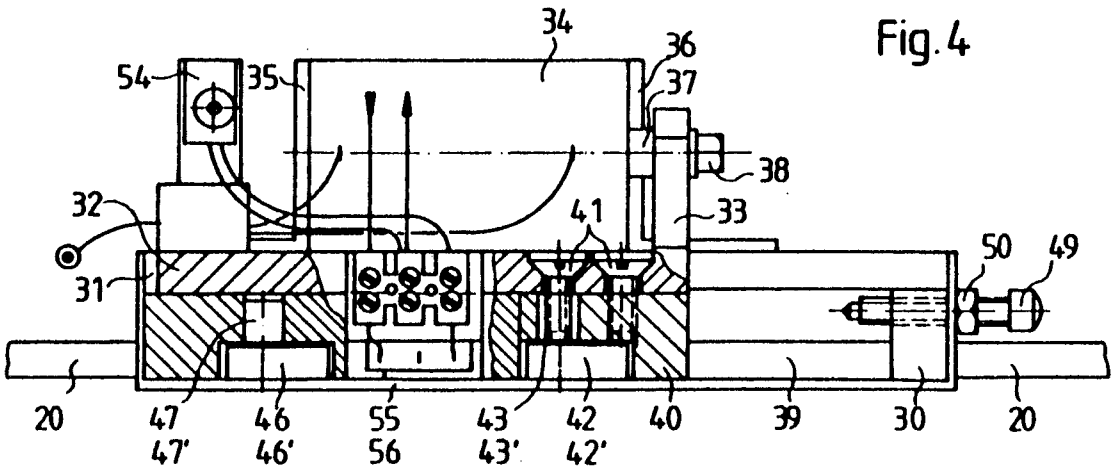

FIG. 4 is a top plan view of the drive station shown in FIG. 3.

Figure 5:
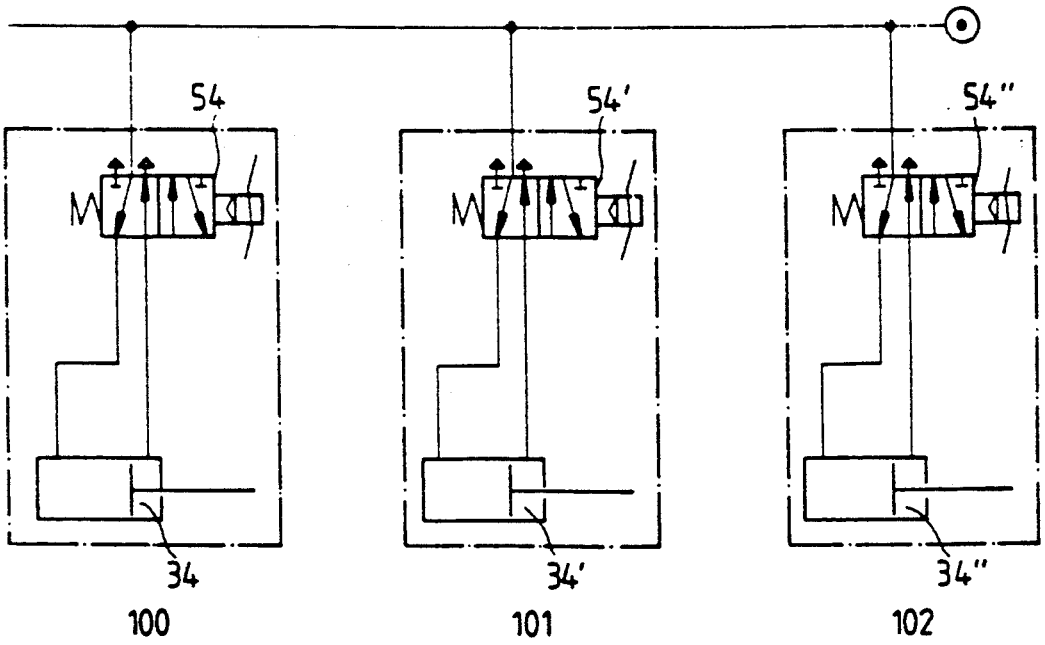

FIG. 5 is a pneumatic diagram of the installation of the present invention.

FIG. *6a* is an electrical diagram of the installation of the present invention wherein the guide piece is advanced discontinuously in successive jumps.

FIG. *6b* is an alternate version of the electrical diagram of the installation of the present invention wherein the guide piece is advanced continuously.

Figure 7:
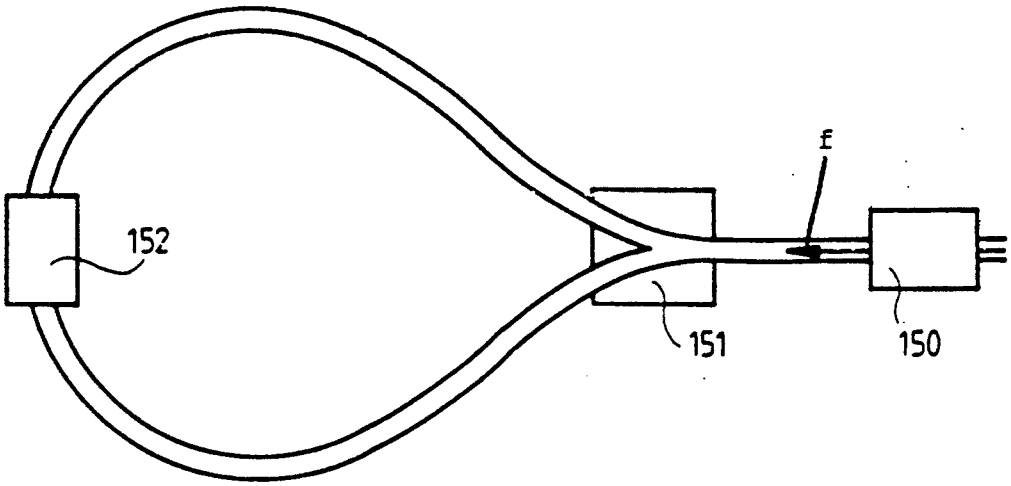

FIG. 7 shows an inactive switch, by means of which it is possible to cause the guide piece to return to its starting point without any intervention.

Figure 8:
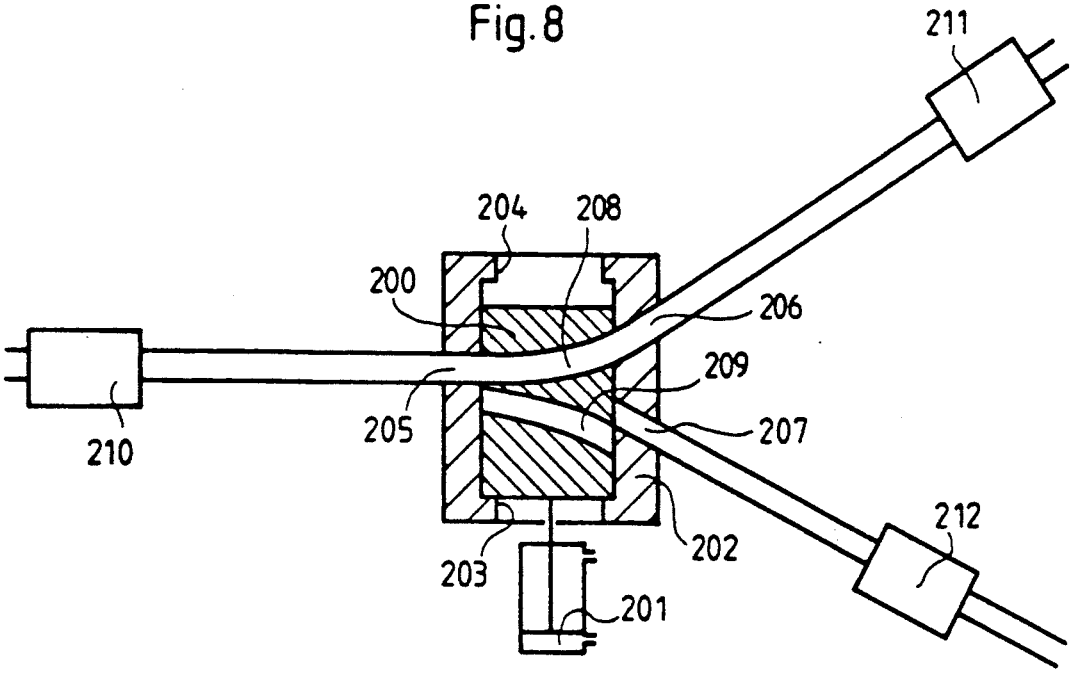

FIG. 8 shows an active switch which makes it possible to select a path by positioning a plastic block by means of a pneumatic jack.

Figure 9:
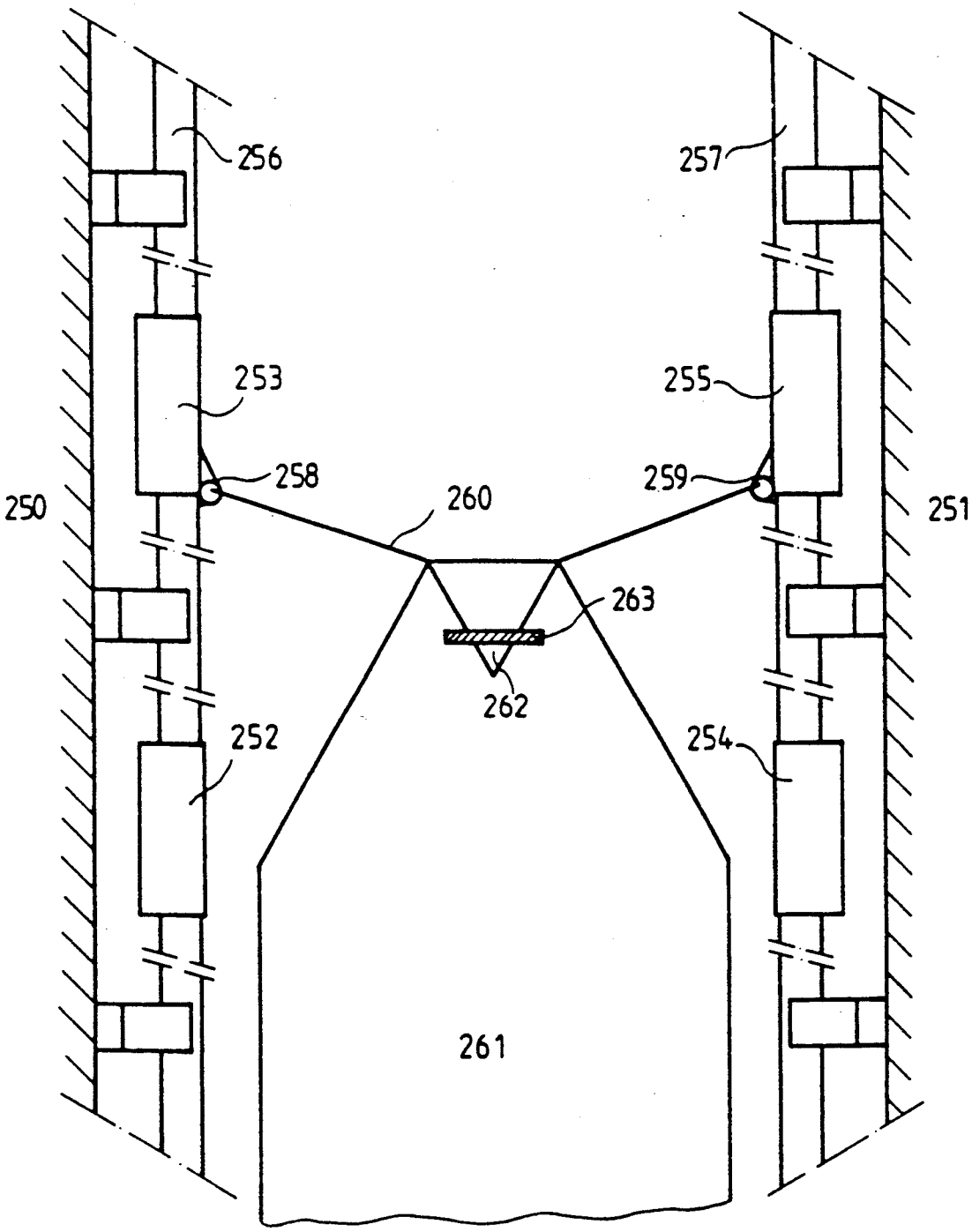

FIG. 9 shows the preferred embodiment of the present invention wherein guide channels and guide pieces are provided on both the operating-side and on the gear-side of the frame of the printing press.

Figure 10:
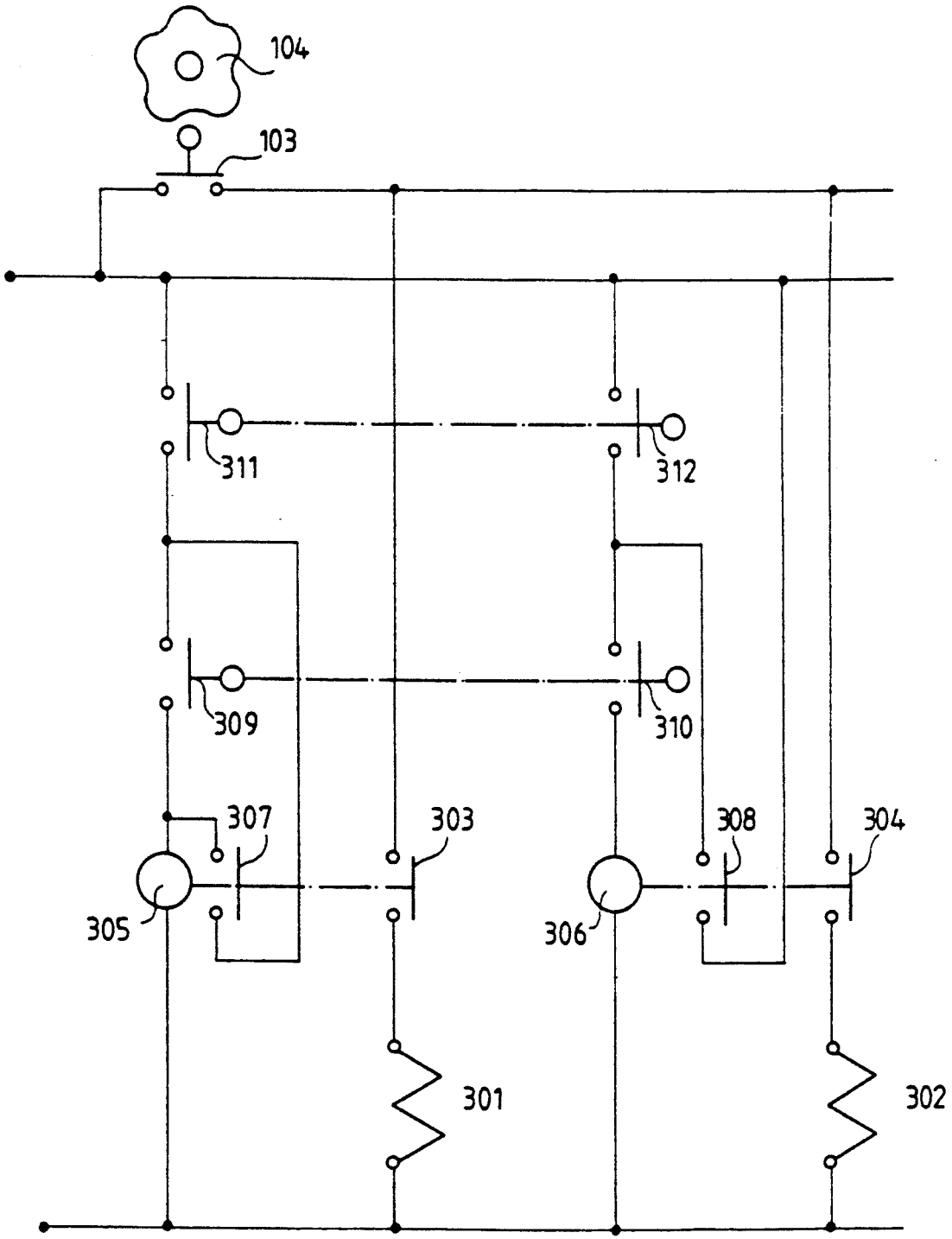

FIG. 10 shows an electrical circuit which makes it possible to couple the operating-side and the gear-side drive stations so that the first guide piece arriving at a station "awaits" that of the other side to ensure the synchronism of the two guide pieces.

DETAILED DESCRIPTION

The web engagement system of the present invention comprises a guide piece 1, as shown in FIG. 1. Preferably, the guide piece 1 is a flexible plastic section which has a square cross-section of 7 mm by 7 mm and a front part 2 which is tapered like the point of a needle. A rear part 3 is split along its center over a length of a few centimeters. A piece 4 preferably made of metal foil (spring steel) and of a thickness of a few tenths of a millimeter is fastened in this slit by means of a plurality of rivets 5. The piece 4 is provided with an orifice 6 for securing the point of the paper web to be engaged.

The web engagement system of the present invention also comprises a guide channel (shown in in FIG. *2a*) for accommodating and guiding the guide piece 1. The tapered front part 2 of the guide piece 1 prevents the guide piece 1 from getting jammed in the discontinuities of the guide channel when the guide piece is advancing.

The guide channel consists of a section 20, preferably of square cross-section of 8×8 mm extruded aluminum and open in the form of a C in the middle of one of its sides. The section 20 is held at a constant distance from the frame of the press 23 by means of spacer pieces 21 adhesively bonded to the section 20 and fastened to the frame 23 by means of screws 22, as shown in FIG. *2b*.

It should be understood that the guide piece 1 and the guide channel need not be square-shaped and C-shaped, respectively, but rather can be of any complementary shapes.

The engagement system further comprises a drive station, which is the most complex part of the system, shown in FIGS. 3 and 4. Its purpose is to propel the guide piece 1 through the guide channel. The body of the drive station consists of a plastic plate 30 of relatively complex shape, provided in its rear face with a guide groove 31 extending over the entire length of the plate 30. A metal sliding block 32 is seated in this guide groove and can slide with gentle friction. Sliding block 32 is equipped at one of its ends with a bracket 33 pierced with a hole.

A pneumatic jack 34 is fastened to the plate 30 by means of brackets 35 and 36. The rod of this jack 37 receives at its end a screw 38 which passes through the hole of the bracket 33 and which thus secures this rod to the sliding block 32.

At the front of the plate 30, a rectangular cavity 39 houses a slide 40 fastened to the sliding block 32 by means of two screws. The slide 40 accommodates two wedging rollers 42 and 42', each equipped with an eccentric pivot pin 43 and 43', which are seated in bores made in the slide 40. The wedging rollers 42 and 42' each carry holes 44 and 44' in their respective pins 43 and 43'. A portion of piano wire 45 connecting the two holes 44 and 44' tends to return the wedging rollers 42 and 42' into a constant intermediate position. Thus, the two wedging rollers 42 and 42' are returned into a constant position which is that in which their cylindrical parts confronting one another are as close to one another as possible. A stop screw 49 immobilized by a lock-nut 50 limits the stroke of the slide 40 under the action of the jack 34 and makes it possible to adjust this stroke.

In the absence of the guide piece 1, the cylindrical parts of the wedging rollers 42 and 42' delimit a space smaller than the width of the guide piece. When the guide piece 1 is introduced between the wedging rollers 42 and 42', it spreads them apart by means of its pyramidal tapered portion and is wedged in one direction. Thus, it can advance in the direction in which it was introduced, but is blocked in the opposite direction. This is true, moreover, whatever the direction in which it was introduced, whether in the direction shown in FIG. 3 or in the opposite direction.

The drive station further comprises two other wedging rollers 46 and 46' completely identical to the rollers 42 and 42', themselves pivoted on eccentric axes 47 and 47' and returned to the mid-position by means of a piano wire 48. These wedging rollers 46 and 46' are themselves mounted directly on the frame 30 of the drive station.

The drive station is also equipped with an electrical breaker 51 which closes a normally open contact when its wheel 52 comes into contact with the guide piece 1. This breaker is connected by means of a terminal strip 53 to the general electrical circuit of the system, which will be described later.

The drive station is also equipped with a solenoid valve 54 of the 5/2 type which is fastened to the frame 30 at the rear of the drive station, as shown in FIG. 4.

FIG. 5 shows only three drive stations bearing the reference numerals 100, 101 and 102. The present invention is not limited to three drive stations, it can comprise any number of stations, depending on the length and complexity of the path.

Each drive station, for example 101, is composed in schematic terms of an electrically controlled springreturn 5/2 solenoid valve. This solenoid valve 54' is connected to the jack 34' of the drive station by means of two pipelines. All the solenoid valves are supplied in parallel with compressed air at 7 bars from the supply network of the press. It is possible to set this general pressure at a level lower than 7 bars by means of a single pressure reducing valve, in order to limit the pull of the system and thus avoid breaking the paper. Thus, when the current is conveyed, for example in a solenoid valve 54', the rod of the jack 34' is displaced from right to left and executes the reverse movement when the current is cut off.

Figure 6:
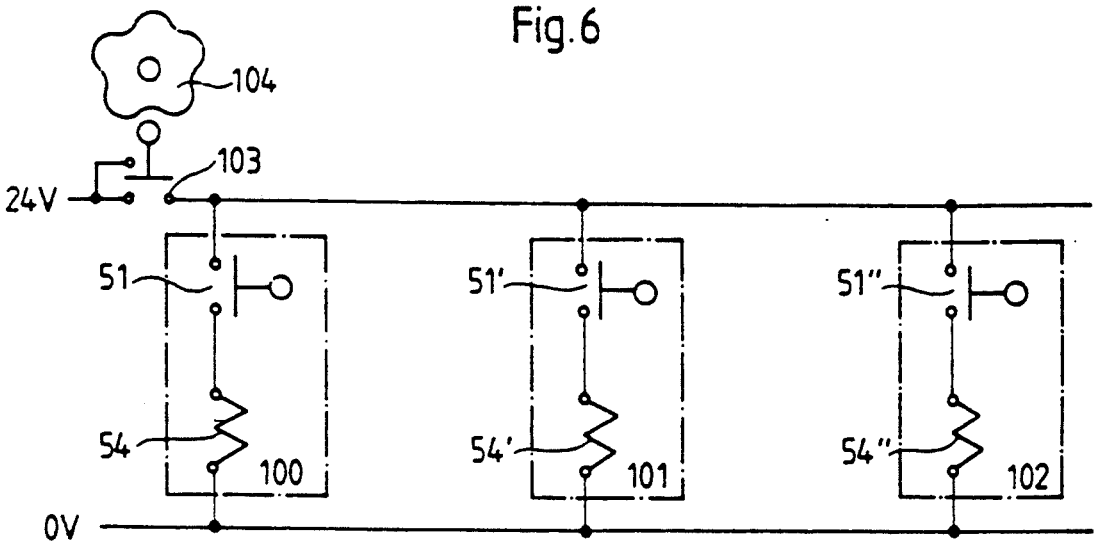

FIG. 6 shows three drive stations though it should be understood that any number of drive stations can be used in an actual installation. The drive stations bear the reference numerals 100, 101 and 102. Each comprises, in series, the electrical breaker 51 and the solenoid valve 54. The various drive stations 100, 101 and 102 are connected in parallel with one another and are supplied at 24 V direct current by means of a network. This circuit is broken by a breaker 103 controlled by a toothed cam 104 which is keyed directly on one of the cylinders of the printing press.

The system operates as follows: The toothed cam 104 driven by the printing press is designed in such a way that it supplies a pulse to the breaker 103, for example every 40 mm of paper. If one of the breakers 51 is closed because the guide piece 1 comes in contact with the wheel 51, the corresponding solenoid valve 54 is energized and deenergized at the rate of advance of the paper, that is to say every 40 mm of paper.

If it is assumed, for example, that the guide piece 1 is in the drive station 101, only the contact 51' being closed, only the solenoid valve 54' will be actuated and will convey air alternately on one side of the piston of the jack 34' and the other each time the paper advances 40 mm.

The stroke of these back and forth movements of the piston will cause back and forth movements of the slide 40. It is possible, by means of the stop screw 49 to adjust the stroke of the slide to approximately 40 mm or slightly more or less. Since, during each stroke of the piston, the wedging rollers 42 and 42' fix the guide piece relative to the slide in only one direction and allow it to slide in the other direction, the guide piece advances by an amount equal to the stroke of the slide.

The stationary wedging rollers 46 and 46' act as pawls and prevent the guide piece I from returning rearwards. FIGS. 3 and 4 show that the guide tube of C-shaped cross-section 20, inside of which the guide piece 1 is displaced, is interrupted in line with a drive station, the ends of these tubes being introduced into cavities milled at the two ends of the drive station. Thus, the guidance of the guide piece 1 during its passage through the drive station is ensured by a groove made in the latter.

Furthermore, two sheet-metal plates 55 and 56 partially reclose this groove and prevent the guide piece 1 from escaping towards the front of the device. These plates are fastened to the frame 30 of the station by means of screws 57 and 58.

According to the electrical installation illustrated in the diagram of FIG. 6, the guide piece 1 advances discontinuously in successive jumps of 40 mm. In fact, in this case, the guide piece 1 has a length slightly greater than the longest distance between two drive stations, so that said guide piece is always actuated at least by one drive station and sometimes simultaneously by two drive stations, on the understanding that the slides of the various active drive stations have a synchronous movement. Thus, when the contact 103 is closed, all the slides 40 of the active drive stations are displaced 40 mm from left to right simultaneously and the guide piece 1 together with them. When the contact 103 is opened, the slides 40 are displaced from right to left in order to return to the initial position and the guide piece 1 remains stationary. The advance of the guide piece 1 is therefore discontinuous in successive jumps of 40 mm.

Figure 6B:
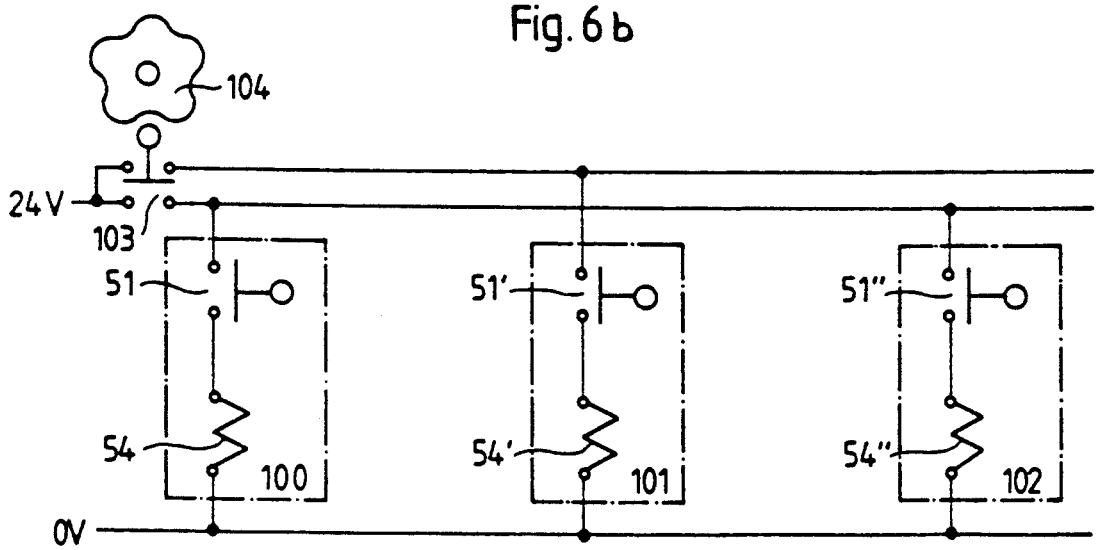

An alternative version of the electrical diagram of FIG. 6 is shown in the electrical diagram of FIG. **6*b*. As can be seen in FIG. 6*b*, the even-numbered drive stations 100, 102 in parallel are supplied by one wire and the odd-numbered drive stations 101 are supplied by another wire. Moreover, the contact 103 has been made inverting, that is to say, when the even-numbered drive stations are being supplied, the odd-numbered stations are not, and vice-versa. The electrical installation illustrated in FIG. 6*b* thus allows a continuous advance of the guide piece 1. In this case, it is especially recommended that the length of the guide piece 1 be at least equal to double the maximum distance between two drive stations. The guide piece 1 is thereby at least engaged in 2 drive stations simultaneously and at most engaged in 3** drive stations.

When the contact 103 is closed, for example for supplying the even-numbered drive stations, the corresponding slides 40 are displaced to the right and the guide piece together with them, while, when the circuit of the odd-numbered stations is open, the corresponding slides 40 are displaced to the left towards the initial position. Consequently, the contact 103 inverts and thus supplies the odd-numbered stations, the even-numbered stations remaining inactive. The alternating movement of the slides of the even-numbered stations and of the odd-numbered stations thereby allows a continuous advance to the right of the guide piece 1 and of the paper web to be engaged. It will be appreciated that, in such a circuit, it is possible to arrange active or inactive switches making it possible to select among a plurality of possible paths of the web.

FIG. 7 illustrates an inactive switch, by means of which it is possible to cause the guide piece to return to its starting point without any intervention. The system comprises a drive station 150 located at the end of a web engagement path. The guide piece 1 arrives at the station 150 in the direction of the arrow f. This station will push it towards the inactive switch 151 where, by virtue of its tapered shape, it will engage either into one channel or into the other and arrive at the station 152 which will be put into operation by means of its breaker and which will push the guide piece 1 until it returns by way of the other channel, point forwards, to the station 150 which it enters in the opposite direction to the arrow f. It will therefore subsequently rerun the entire route in the opposite direction. It is unimportant whether the guide piece 1 initially takes one of the channels or the other, it will return by way of the channel opposite the station 150. This system of course also permits all kinds of active switches of a known type, for example by the substitution of one path for another, by means of slides recessed in blocks of plastic.

FIG. 8 shows such an active switch. This switch makes it possible to select a path by positioning a plastic block 200 beforehand by means of a pneumatic jack 201. The plastic block 200 slides in a stationary part 202 which is likewise made of plastic and which comprises molds 203 and 204 functioning as abutments for the block 200 which can thereby occupy only two positions, depending on whether the jack pushes or pulls. When the jack pulls the block downwards, the channels 205 and 206 communicate by means of the groove 208 made in the block 200. When the jack pushes the block upwards, the channels 205 and 207 communicate by means of the groove 209 made in the block 200, 210, 211 and 212 are drive stations. A large number of switches can thus be provided along the path of the guide piece 1.

The paper web can be pulled on only one side of the frame of the machine, with an asymmetric point being made in the paper. In this arrangement, the web engagement system is then present only on one side, and the web is attached in the orifice 6 made in the metal foil 4 at the rear of the guide piece 1 by means of adhesive tape (see FIG. 1). A preferable solution involves providing a web engagement system on the operating-side of the frame and another identical one on the gear-side of the frame, the two systems facing one another (see FIG. 9). Each system is then equipped with a separate guide piece, the two guide pieces being connected by means of a yarn which pulls the web on which a point has been made at its center.

In FIG. 9, 250 is the gear-side of the frame and 251 the operating-side of the frame. 252, 253, 254 and 255 are drive stations, while 256 and 257 are respectively the guide channels on the gear-side and on the operating-side. 258 and 259 are the attachment loops formed at the rear of the two guide pieces, while 260 is a textile yarn connecting these two loops, and 261 is the web to be engaged, at the center of which an engagement point 262 has been made. This point is folded over the yarn and fastened to the web by means of adhesive tape 263. The advantage of this system is that it pulls the web at its center and symmetrically.

To ensure the synchronism of the two guide pieces, two systems are employed. The first system involves adjusting the screws 49 of the various drive stations (FIGS. 3 and 4) in order to obtain synchronism. The second system involves electrically coupling the gear-side and operating-side drive stations so that the first guide piece arriving at a station "awaits" that of the other side.

FIG. 10 is a schematic diagram of an electrical circuit for making it possible to solve this problem. In this arrangement, the electrical system shown in FIG. 10 replaces that of FIG. 6 or FIG. 6*b*. The 24 volt direct current is always chopped by the system connected to the cylinder of the machine: cam 104 and breaker 103. This chopped voltage supplies the coils of the gear-side 301 and operating-side 302 solenoid valves. Contacts 303 and 304 are placed on this circuit and are controlled by the relays 305 and 306, these relays being self-supplied by their contacts 307 and 308. The contactors which detect the presence of the gear-side guide piece are equipped with two contacts 309 and 310 and likewise those which detect the presence of the operating-side guide piece are equipped with the contacts 311 and 312. It can be seen that, after a shutdown, the two contacts 303 and 304 will close only if the breakers of the two drive stations (gear and operating) detect a guide piece simultaneously. In contrast, the drive station on a particular side will shut down only when the guide piece on this side has left its drive station.

We claim:

1. A web engagement system for an off-reel printing press having a frame, comprising:

a guide piece;

a guide channel;

a plurality of drive stations for displacing the guide piece, the guide channel serving for accommodating and guiding the guide piece and being located on the frame of the press between the drive stations, the guide piece being slightly longer than the distance separating the various drive stations; and wherein each drive station has a slide equipped with wedging rollers which advances the guide piece by alternately gripping and releasing it.

2. A web engagement system for an off-reel printing press having a frame, comprising:

at least one guide piece;

at least one guide channel mounted to the frame of the printing press for accommodating and guiding the at least one guide piece; and a plurality of drive stations located along the at least one guide channel for displacing the at least one guide piece, each drive station comprising a slide equipped with wedging rollers which advance the at least one guide piece by alternately gripping and releasing it.

3. The web engagement system according to claim 2, wherein each drive station further comprises a pair of wedging rollers which prevent the return movement of the at least one guide piece.

4. The web engagement system according to claim 2, wherein each drive station further comprises a pneumatic jack supplied by a solenoid valve which generates a back and forth movement that displaces the slide causing the at least one guide piece to advance, the pneumatic jack and solenoid valve both being fastened to the drive station.

5. The web engagement system according to claim 4, wherein each drive station further comprises a limit breaker for detecting the presence of the at least one guide piece and activating the supply of the solenoid valve.

6. The web engagement system according to claim 5, wherein electrical pulses are sent to the drive stations generated by the rotation of the printing press which drives a cam acting on the limit breaker generating a number of pulses proportional to the rotation of the press.

7. The web engagement system according to claim 6, wherein each drive station is reversible.

8. The web engagement system according to claim 7, wherein even-numbered drive stations are connected to one another by means of one electrical line, and odd-numbered drive stations are likewise connected to one another by means of another electrical line.

9. The web engagement system according to claim 8, wherein the supply of current to the electrical lines is ensured by an inverting contact actuated as a result of the rotation of the press, in such a way that the even-numbered drive stations and the odd-numbered drive stations are alternately supplied with voltage, and in that this arrangement, in conjunction with the at least one guide piece slightly longer than double the distance separating two drive stations, allows a virtually continuous displacement of the flexible guide piece and of the paper web to be engaged.

10. The web engagement system according to claim 2, further comprising active switches or deflecting stations located along the at least one guide channel which modify the path of the at least one guide piece.

11. The web engagement system according to claim 10, further comprising fixed return loops or deflecting stations for automatically returning the at least one guide piece to its initial position.

12. The web engagement system according to claim 9, wherein identical systems are located on opposite sides of the frame of the printing press, one being located on the gear-side of the printing press and the other located on the operating-side of the printing press.

13. The web engagement system according to claim 12, wherein one guide channel and associated guide piece and drive stations are located on the operating-side of the frame, and a second guide channel and associated guide piece and drive stations are located on the gear-side of the frame.

14. The web engagement system according to claim 13, wherein the electrical supply circuit of the solenoid valves of the drive stations on the operating-side and the gear-side of the frame is designed in such a sway that the two guide pieces are simultaneously set in movement when both have arrived at the corresponding drive stations, while, at a stop, the advancing movement of a drive station is transmitted to one guide piece even though the other piece is already stopped.

15. The web engagement system according to claim 14, further comprising a yarn connecting the guide pieces of the identical systems to the web at its center for pulling the web through the printing press.

16. The web engagement system according to claim 15, further comprising an electrical device for ensuring the synchronization of the guide pieces located on one side of the printing press or the other.

17. The web engagement system according to claim 2, wherein the at least one guide piece is flexible.

18. The web engagement system according to claim 2, wherein a cross section of the at least one guide channel is substantially C-shaped and a cross section of the at least one guide piece is substantially square-shaped.

19. The web engagement system according to claim 2, wherein the at least one guide piece is slightly longer than the distance between adjacent drive stations.

* * * * *